US005986229A

United States Patent [19]

Raffoux

[11] Patent Number: 5,986,229

[45] **Date of Patent: *Nov. 16, 1999**

[54] PUSH-BUTTON PROVIDING TACTILE AND AUDIBLE SIGNALS

[75] Inventor: Philippe Raffoux, Champniers, France

[73] Assignee: Schneider Electric SA, Boulogne Billancourt, France

[ * ] Notice: This patent issued on a continued prosecution application filed under 37 CFR 1.53(d), and is subject to the twenty year patent term provisions of 35 U.S.C. 154(a)(2).

[21] Appl. No.: 09/050,134

[22] Filed: Mar. 30, 1998

[30] Foreign Application Priority Data

Apr. 7, 1997 [FR] France ..... 97 04315

[51] Int. Cl.[6] ..... H01H 13/14

[52] U.S. Cl. ..... 200/521; 200/341

[58] Field of Search ..... 200/524, 521, 200/341, 308

[56] References Cited

U.S. PATENT DOCUMENTS

| | | | |
|---|---|---|---|
| 4,417,115 | 11/1983 | Desmarais et al. | 200/340 |
| 4,931,607 | 6/1990 | Berger | 200/524 |
| 5,510,589 | 4/1996 | Arnal | 200/522 |

FOREIGN PATENT DOCUMENTS

| | | |
|---|---|---|
| 0 721 196 A1 | 7/1996 | European Pat. Off. . |
| 1169 549 | 5/1964 | Germany . |
| 35 45 621 | 6/1986 | Germany . |
| 2 051 481 | 1/1981 | United Kingdom . |

*Primary Examiner*—Michael L. Gellner
*Assistant Examiner*—Nhung Nguyen
*Attorney, Agent, or Firm*—Oblon, Spivak, McClelland, Maier & Neustadt, P.C.

[57] ABSTRACT

Pulse push-button which includes a tubular pusher member guided in translation through a cylindrical body and acting on electrical contacts. The pusher member is fitted with a cam that operates in conjunction with the active section, for example an elbowed tip, of a hairpin-shaped spring. The cam has at least one reversing point and the adjacent wall of the pusher is also fitted with a step member that allows the active section of the spring to strike the bottom of the step when the elbow passes over the step.

7 Claims, 4 Drawing Sheets

PUSH-BUTTON PROVIDING TACTILE AND AUDIBLE SIGNALS

FIELD OF THE INVENTION

The present invention relates to a pulse push-button comprising a tubular pusher member housed coaxially in a cylindrical body and acting on electrical contacts, the pusher member being guided in translation in the body and acted upon by a return spring.

DISCUSSION OF THE BACKGROUND

This type of push-button, also known as a single-push button, is well known. The user presses a finger on the pusher, which descends and moves to the electrical contacts. When the user's finger releases pressure on the pusher, the pusher rises under the influence of the return spring and the contacts return to their initial state and the pusher regains its initial position.

The absence in known slaved pulse push-buttons of simple auditory and tactile signals indicating that the contacts have been correctly activated is disadvantageous. Moreover, quick-release push-buttons are known in the art that provide rapid commutation, for example by overrunning the dead center of springs. Commuting in this type of quick-release push-button is accompanied by an audible and tactile signal, but this naturally requires the presence of a quick-release mechanism.

In known catching push-buttons, also known as push-push or double-push buttons, a cam with a catching zone that may, for example, be heart-shaped, is used in combination with a hairpin-shaped spring so that at the end of the downward movement of the pusher, the hairpin-shaped spring catches the catching zone of the cam and prevents the pusher from rising. The next time the pusher is activated the hairpin-shaped spring is freed from the catching zone during the downward movement of the pusher and the pusher is allowed to rise freely. However, this type of mechanism is dedicated to a specific catching mechanism of the type of button under consideration.

SUMMARY OF THE INVENTION

The aim of the invention is to use simple means to provide the user of a single-action slaved push-button with auditory and tactile feedback, i.e. without quick-release, said feedback indicating the correct operation of the push-button.

According to the invention, the push-button has a wall fitted with a cam that operates in conjunction with the active section, for example the tip, of a hairpin-shaped spring, said spring being embedded in the body and storing energy from being flexed by the cam. The edge of the cam has at least one reversing point. The entire edge of the cam is tracked without catching by the active section of the spring following an actuation cycle of the pusher, i.e. a movement in which the pusher descends then rises. The wall of the pusher is also fitted with a step associated with the reversing point to allow the active section of the spring to jump.

This combination of a loop-effect cam and a step is a simple way of providing the desired auditory and tactile sensations. The end of the spring is preferably an elbow whose radial tip is capable of striking the bottom of the step when the elbow moves past the step.

BRIEF DESCRIPTION OF THE DRAWINGS

The following description is of a non-limitative embodiment of the invention and refers to the attached figures.

DESCRIPTION OF THE PREFERRED EMBODIMENTS

Figure 1:
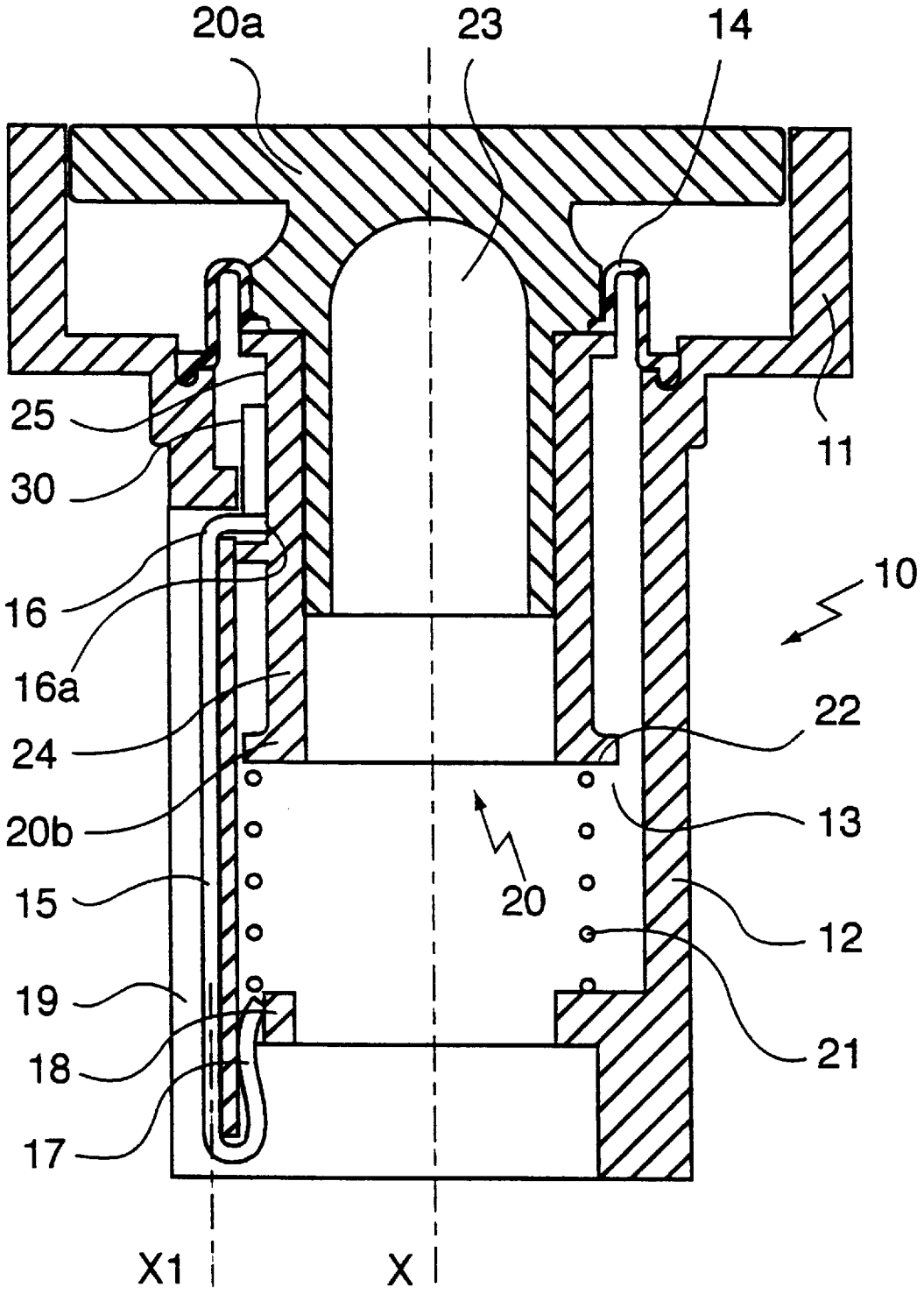
FIG. 1 shows a cross-section of a push-button according to the invention.
Figure 2:
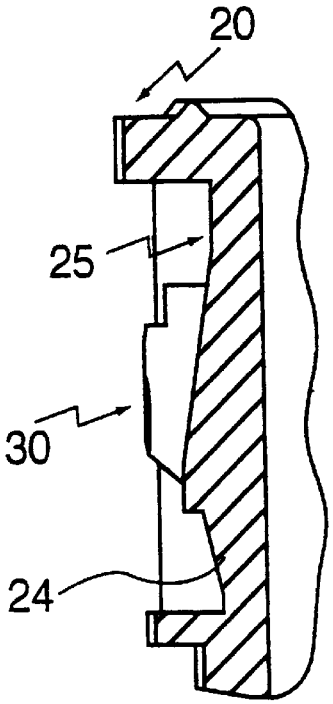
FIG. 2 is an enlarged view of a portion of FIG. 1.
Figure 3:
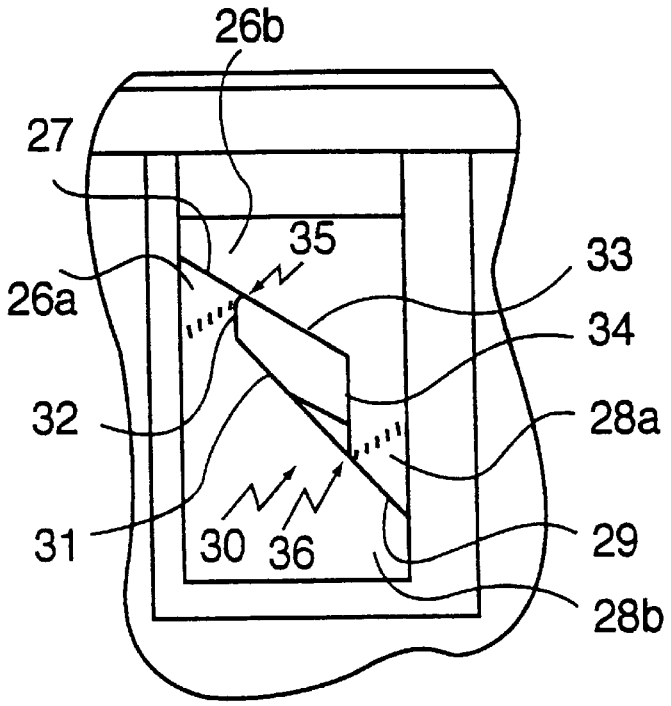
FIG. 3 is a view of a detail of FIG. 2.
Figure 4:
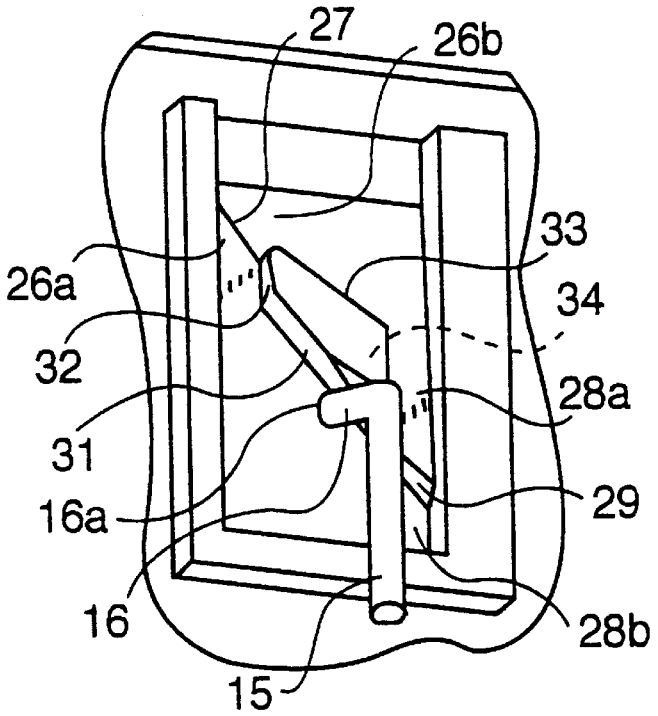
FIG. 4 is a perspective view of the cam of the push-button.

The pulse push-button shown in FIG. 1 comprises a tubular body 10 that is generally cylindrical in shape and whose axis is indicated by the symbol X. The push-button is fitted with a head 11 that is flared in relation to the barrel 12. Body 10 contains, coaxially disposed, a pusher member 20 that is generally cylindrical in shape and composed of an upper section 20*a* that is flared to fit into head 11 and a lower section 20*b* constructed as part of section 20*a*, and movable within barrel 12. The pusher moves inside body 10 so that it moves in translation along axis X when pressure is exerted on its upper section 20*a*, acting against the effort exerted by coaxial helicoidal return spring 21 while being prevented from rotating around axis X. The pusher is stopped in the upper position in the body by stop means (not shown). The term "cylindrical" should be understood to include prismatic or similar shapes.

The rotation of the pusher is retained and guided by opening means of suitably shaped elements such as that indicated by 13 and flange 22. The pusher 20 is fastened to the body by a leaktight seal 14 and comprises an inner chamber 23 that may be used to house an indicator lamp.

The cylindrical perimeter of pusher 20 is composed of a wall 24 whose outer surface 25 bears a cam 30 that operates in conjunction with the active section 16, preferably the radially-elbowed tip towards axis X, of a spring 15 shaped like a hairpin or similar. Tip 16*a* located towards axis X of a first terminal section 16 presses against surface 25. The second terminal section 17 of spring 15 is embedded in housing 18 of the lower end of body 10.

It should be noted that spring 15 runs in a direction X1 parallel to X the length of the wall of the cylinder of barrel 12, preferably in a groove or slot 19 cut in the wall. As will be seen below, spring 15 is acted upon by the cam such that the resulting flexion causes storage of energy that provides the desired tactile and auditory effect together with a percussive effect due to the release of the tip of the spring striking suitably-shaped surface 25.

Cam 30 is more or less in the shape of a parallelogram, having two sides 32, 34 that are roughly parallel to axis X of the body and two other oblique sides 31, 33. Oblique side 33, located towards the head 11 of the push-button, is a continuous flat or convex surface and oblique side 31 of the cam, located on the other side from the head, may also have a continuous surface (see FIGS. 5A–5E) or a discontinuous surface that offers tactile resistance (see FIG. 6). The cam has a reversing point 35 (an acute angle of the parallelogram) at the juncture of sides 32, 33 and another reversing point 36 at the juncture of sides 34, 31.

The outer surface 25 of wall 24 comprises a ramp 26*a* that rises slightly to guide the tip 16*a* of elbow 16 of spring 15 along side 31 and a dished area or similar indentation 26*b* adjacent to ramp 26*a* that provides a step 27 in the region of reversing point 35. Similarly, a ramp 28*a* that rises slightly to guide the tip 16*a* of elbow 16 along side 34 and an indentation 28*b* adjacent to ramp 28*a* that provides a step 29 in the region of reversing point 36.

Figures 5A, 5B, 5C, 5D, 5E:
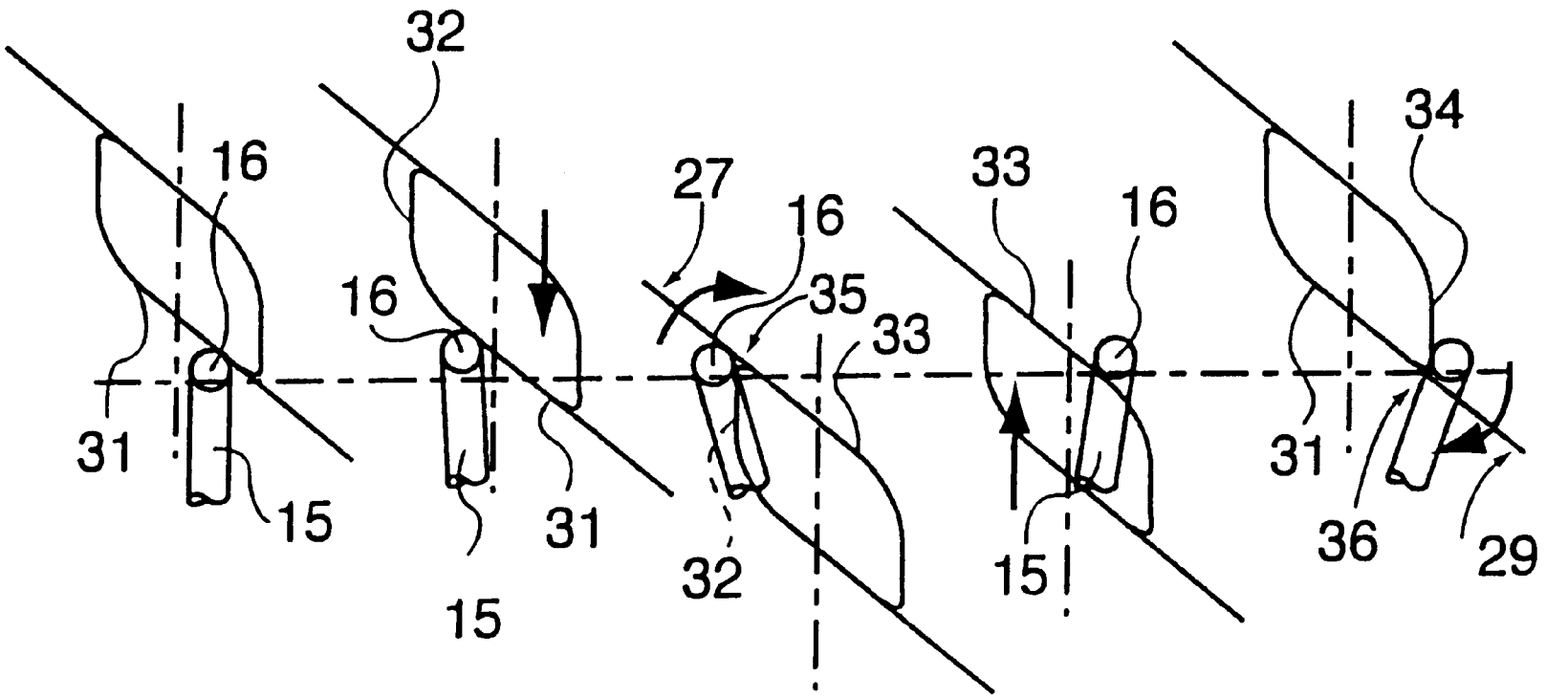
FIGS. 5A to 5E show the various stages of movement of the cam relative to the spring during an actuation cycle of the push-button.

The push-button described above operates as follows:

The initial position is shown in FIGS. 1 and 5A. In this position, the pusher 20 presses against part of the body while the upper surface of elbow 16 is located in the immediate region of lower side 31 of cam 30 or is applied to this side, the spring being at rest.

When a user actuates the push-button by pressing the upper section 20*a* with a finger, the pusher 20 descends, and with it cam 30 (FIG. 5B) so that side 31 of the cam pushes elbow 16 of spring 15 to the left. The spring is flexed and remains flexed while elbow 16 slides along side 32 of the cam as far as reversing point 35 (see FIG. 5C). When it moves past step 27 associated with point 35, the end 16*a* of elbow 16 releases the stored energy and strikes the bottom of indentation 26*b*. The user then hears a sound indicating that the required action has been carried out; at the same time the user's finger feels a reaction transmitted by the cam and the pusher. Chamber 23 inside the pusher amplifies the sound.

As it rises, the pusher causes the spring to flex towards the right (see FIG. 5D) following the sliding of side 33 of the cam against the elbow 16. Finally, tip 16*a* of elbow 16 travels up ramp 28*a* and, when the elbow passes beyond reversing point 36 and the associated indentation 29 (FIG. 5E), it strikes surface 25 in indentation 28*b* so that the user hears a sound and feels a tactile sensation as before. It will be clear that the measurements of the reversing points, ramps and indentations may be calculated, for example, so as to stress the first indication (indentation 27). Similarly only a single indentation may be provided.

Figure 6:
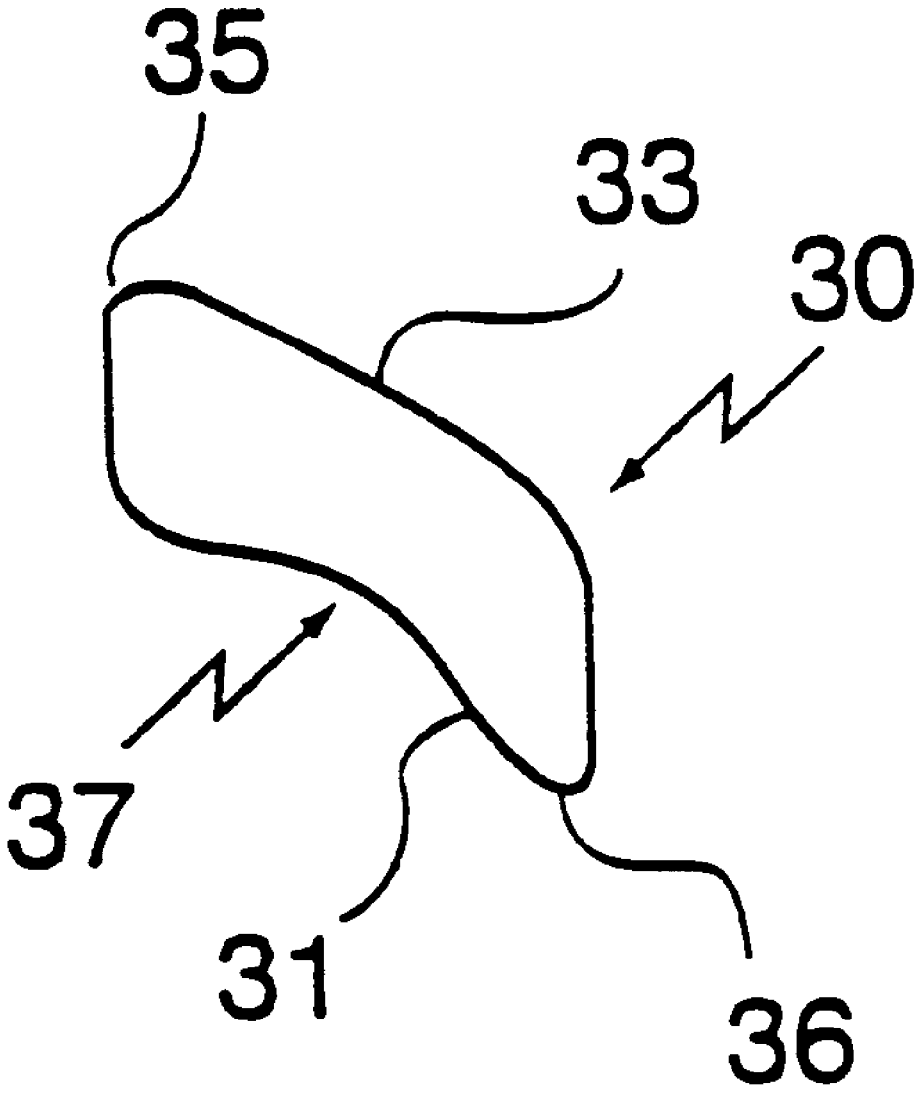
FIG. 6 shows a variant embodiment of the cam.

FIG. 6 shows a variant in which a discontinuity 37 is provided in side 31 of cam 30 to provide tactile resistance at the beginning of the actuation cycle. The cams given as examples may, naturally, be differently shaped.

I claim:

1. Pulse push-button, comprising:

a tubular pusher member having a wall that is housed coaxially in a tubular body to act on electrical contacts, said pusher member being guided in transition in the body and being acted upon by a return spring, wherein:

the wall of the pusher is fitted with a cam that operates in conjunction with an active section of a hairpin-shaped spring, said spring being embedded in the body and storing energy from being flexed by the cam;

an edge of the cam has at least one reversing point, said edge being entirely tracked without catching by an active section of the spring during an actuation cycle of the pusher, and wherein the outer surface of the wall is fitted with a step associated with a reversing point such that both an auditory and tactile sensation is generated by said cam and said step for indicating correct operation of said pusher member.

2. Push-button of claim 1 wherein the active section of the spring comprises a terminal section in the shape of an elbow having an end which strikes the bottom of the step when the elbow moves past the step.

3. Push-button of claim 1 wherein the edge of the cam comprises first and second reversing points and the outer surface of the wall comprises first and second steps for sudden releasing of an end of the active section of the spring at each reversing point.

4. Push-button of claim 1 wherein said cam is substantially parallelogram shaped, said at least one side comprises first and second sides that are substantially parallel to an axis (X) of the body and said cam includes third and fourth sides that are oblique, one of said oblique sides being located towards a head of the push-button and including one of an unbroken flat surface and a convex surface.

5. Push-button of claim 1 wherein one of said oblique sides of the cam is located on a side opposite the head and is provided with a discontinuity to provide tactile resistance to movement of said pusher.

6. Push-button of claim 1 wherein the spring extends in a direction parallel to the axis of body (10) in a groove or slot (19) formed in the body.

7. Push-button of claim 1 wherein said cam comprises at least one side which is substantially parallel to an axis of the body and at least oblique side which is located towards said head.

* * * * *